US006439831B1

(12) United States Patent
Conrad

(10) Patent No.: US 6,439,831 B1
(45) Date of Patent: Aug. 27, 2002

(54) METHOD AND APPARATUS FOR IMPROVING EFFICIENCY AND/OR ALTERING ACOUSTIC SIGNATURE OF SURFACE AND SUBMERGED VESSELS

(76) Inventor: Wayne Ernest Conrad, 27 King Street, Hampton (CA), L0B 1J0

( * ) Notice: Subject to any disclaimer, the term of this patent is extended or adjusted under 35 U.S.C. 154(b) by 0 days.

(21) Appl. No.: 09/594,716

(22) Filed: Jun. 16, 2000

(30) Foreign Application Priority Data

Apr. 20, 2000 (CA) ..... 2306291

(51) Int. Cl.[7] ..... F04D 29/68

(52) U.S. Cl. ..... 415/1; 415/118; 415/119; 415/914

(58) Field of Search ..... 415/1, 118, 119, 415/914; 440/6; 114/67 A, 67 R; 417/411

(56) References Cited

U.S. PATENT DOCUMENTS

| | | | | |
|---|---|---|---|---|
| 4,009,416 A | | 2/1977 | Lowther | 315/176 |
| 4,198,706 A | * | 4/1980 | Elliott | 367/148 |
| 4,376,263 A | | 3/1983 | Pittroff et al. | 320/32 |
| 4,429,652 A | * | 2/1984 | Stol | 114/20 R |
| 4,441,147 A | | 4/1984 | Schwarz et al. | 363/21 |
| 5,029,143 A | * | 7/1991 | McCracken et al. | 367/1 |
| 5,373,434 A | | 12/1994 | Malik | 363/56 |
| 5,474,480 A | * | 12/1995 | Schwarz et al. | 440/86 |
| 5,673,184 A | | 9/1997 | Rilly et al. | 363/21 |
| 5,747,977 A | | 5/1998 | Hwang | 323/284 |
| 5,756,182 A | * | 5/1998 | Landi et al. | 428/116 |
| 5,886,880 A | | 3/1999 | Hisanaga | 363/20 |
| 5,942,858 A | | 8/1999 | Sokolov et al. | 315/246 |
| 5,994,883 A | | 11/1999 | Liu | 323/237 |
| 6,026,126 A | | 2/2000 | Gaetano | 375/296 |
| 6,111,230 A | | 8/2000 | Cao et al. | 219/501 |

* cited by examiner

*Primary Examiner*—Edward K. Look
*Assistant Examiner*—Ninh Nguyen
(74) *Attorney, Agent, or Firm*—Philip Mendes da Costa; Bereskin & Parr

(57) ABSTRACT

A power control system for driving a vessel (which may be manned or unmanned) is used to provide a series of pulse trains to the system wherein at least one pulse within each series of pulse trains provides a differing amount of power. Preferably, a portion of the series of pulse trains which has a duration of 10% of the duration of the pulse train delivers more than 20% of the total power to the drive member for the vessel which the drive member receives each cycle. In this way, the noise signature of a vessel is reduced or is varied to match the noise signature of another vessel or wildlife of a natural phenomenon.

22 Claims, 10 Drawing Sheets

METHOD AND APPARATUS FOR IMPROVING EFFICIENCY AND/OR ALTERING ACOUSTIC SIGNATURE OF SURFACE AND SUBMERGED VESSELS

FIELD OF THE INVENTION

This invention relates to a method and apparatus for improving the speed and fuel economy of manned and unmanned vehicles and in particular power systems thereof. This invention also relates to a method and apparatus for altering the acoustic signature economy of manned and unmanned vehicles.

BACKGROUND OF THE INVENTION

A cross section of a sub surface vessel known in the art is shown in FIG. 1. The drive train described within FIG. 1 is also applicable to surface vessels. It is common for surface and subsurface vessels to be powered by a nuclear or diesel driven electric generator or batteries. The propulsion system of the subsurface vessel 1 includes a nuclear or diesel driven electric generator or battery pack 2 which produces either alternating current or direct current electricity except for batteries which only produce direct current. The alternating current or direct current electricity is in turn delivered to the motor 8 by means of wires 6 and 7. The output shaft 9 of the electric motor 8 is supported by means of a bearing 10 and has a propeller 11 affixed to it. When AC or DC electricity is applied to the electric motor 8, the shaft of an electric motor 9 begins to rotate and accelerate to a uniform rotational velocity (rpm) thereby causing the propeller 11 to spin. The rotation of the propeller 11 in turn causes the fluid 12 within which the vessel 1 is suspended to be ejected from the propeller 11 in a direction 13 when the vessel 1 wishes to move forward in the direction 14. By reversing the direction of rotation of the electric motor 8 the fluid 12 within which the vessel is suspended would flow in direction 10 from the propeller 11 thereby causing the vessel 1 to move in the direction 13. In this arrangement, the cavitation of the propeller and the mechanical resonance of the generator, electric motor and associated mechanical linkages produce a distinct and characteristic noise "signature" which can be used to identify the vessel and determine its approximate speed. Furthermore, this system cannot achieve a thermodynamic efficiency in excess of 40%, and typically less than 30%.

A cross section of another design of subsurface vessel known in the art is shown in FIG. 2. The drive train described within FIG. 2 is also applicable to surface vessels. It is common for surface and subsurface vessels to be powered by a nuclear or diesel driven electric generator or batteries. The propulsion system of the subsurface vessel 15 includes a nuclear or diesel driven electric generator 16 which produces either alternating current or direct current electricity except for batteries which only produce direct current. The alternating current or direct current electricity is in turn delivered to the motor 17 by means of wires 18 and 19. The output shaft 20 of the electric motor 17 is coupled to a clutch 21 which selectively engages and disengages the electric motor 17 from the gear box 24. The output shaft 23 the clutch 21 is coupled with the gear box 24 whose output shaft 25 has the propeller 22 affixed thereto. A bearing 26 supports the output shaft from the gear box 24. The purpose of the gear box 24 is to reduce the high rotational speed from the shaft 20 of the motor 17 to a rotational speed suitable for driving the propeller 22. When AC or DC electricity is applied to the electric motor 17, the shaft of a electric motor 20 begins to rotate and accelerate to a uniform rotational velocity (rpm). When the clutch 21 is engaged the rotational energy of the electric motor is transferred to the gear box 24 by means of shaft 23 which in turn causes shaft 25 to spin which thereby causes the propeller 22 to spin. The rotation of the propeller 22 in turn causes the fluid 27 within which the vessel 15 is suspended to be ejected from the propeller 22 in a direction 28 when the vessel 15 wishes to move forward in the direction 29. By reversing the direction of rotation of the electric motor 17 the fluid 27 within which the vessel 15 is suspended would flow in direction 29 from the propeller 22 thereby causing the vessel 15 to move in the direction 28. Alternately, the position of the clutch 21 and the gear head 24 may be reversed in their mechanical connection. In this embodiment, the cavitation of the propeller and the mechanical resonance of the generator, electric motor and associated mechanical linkages produce a distinct and characteristic noise "signature" which can be used to identify the vessel and determine its approximate speed. Furthermore, this system cannot be achieve a thermodynamic efficiency in excess of 40%, and typically less than 30%.

A cross section of a design for a surface vessel known in the art is shown in FIG. 3. The drive train described within FIG. 3 could be applicable to subsurface and other vessels. It is common for surface vessels to be powered by diesel or gasoline engine 30. The propulsion system of the surface vessel 30 includes a diesel or gasoline engine 31. The output shaft 32 of the diesel or gasoline engine 31 is coupled to a clutch 33 which selectively engages and disengages the diesel or gasoline engine 31 from the gear box 33. The output shaft 34 of the clutch 32 is coupled with the gear box 35 whose output shaft 36 has the propeller 37 affixed thereto. A bearing 38 supports the output shaft 36 from the gear box 35. The purpose of the gear box 35 is to reduce the high rotational speed from the shaft 20 of the diesel or gasoline engine 31 to a rotational speed suitable for driving the propeller 37. When the diesel or gasoline engine 31 is started, the output shaft 32 of the diesel or gasoline engine 31 begins to rotate and accelerate to a uniform rotational velocity (rpm). When the clutch 33 is engaged the rotational energy of the diesel or gasoline engine 31 is transferred to the gear box 35 by means of shaft 34 which in turn causes shaft 36 to spin which thereby causes the propeller 37 to spin. The rotation of the propeller 37 in turn causes the fluid 39 within which the vessel 30 is immersed to be ejected from the propeller 37 in a direction 40 when the vessel 30 wishes to move forward in the direction 41. By reversing the direction of rotation of the propeller 37, the fluid 39 within which the vessel 30 is immersed would flow in direction 41 from the propeller 37 thereby causing the vessel 30 to move in the direction 40. In this arrangement, the cavitation of the propeller and the mechanical resonance of the generator, electric motor and associated mechanical linkages produce a distinct and characteristic noise "signature" which can be used to identify the vessel and determine its approximate speed. Alternately, the position of the clutch 33 and the gear head 35 may be reversed in their mechanical connection. Furthermore, this system cannot be achieve a thermodynamic efficiency in excess of 40%, and typically less than 30%.

A cross section of a design for a torpedo known in the art is shown in FIG. 4. It is common for a torpedo to be powered by a combustion engine 42 which receives self-oxidizing fuel from a fuel reservoir 43 by means of a fuel pump 44 which delivers a steady stream of fuel through tube 45. The combustion engine 42 causes a constant rotation of the shaft 46 which is supported by bearing 47 and to which propeller 48 is affixed. The guidance and control systems of such a device are not of concern in this invention and any known in the art may be used. When the combustion engine 42 is started, the output shaft 46 begins to rotate and accelerate to a uniform rotational velocity (rpm). The rotational energy of the combustion engine 42 is transferred to the propeller 48 by means of shaft 46. The rotation of the propeller 48 in turn causes the fluid 49 within which the torpedo 42 is immersed to be ejected from the propeller 48 in a direction 50 which causes the torpedo 42 to move forward in the direction 51. In this embodiment, the cavitation of the propeller and the mechanical resonance of the generator, electric motor and associated mechanical linkages produce a distinct and characteristic noise "signature" which can be used to identify the torpedo and determine its approximate speed. Furthermore, this embodiment cannot be a thermodynamic efficiency in excess of 40%, and typically less than 30%.

SUMMARY OF THE INVENTION

This invention relates to a method and apparatus for improving the speed and fuel economy of aircraft, surface vessels, sub-surface vessels, missiles and torpedoes. This invention also provides a method and apparatus for altering the acoustic signature of such aircraft, surface vessels, sub-surface vessels, missiles or torpedoes which is of tactical military utility.

By way of example, and without being limited in the future by theory, as a fluid including air or water passes over a fluid moving member such as a propeller, impeller, turbine, blade or the like, a Prandtl layer forms along the fluid moving member as well as a series of additional boundary layers. For a given fluid moving member velocity, a specific number of boundary layers of a given thickness form. The upper boundary layers are less stable than lower layers and tend to delaminate. In delaminating, these upper boundary layers form vortical flow patterns which dissipate energy but do not contribute significantly to the net movement of the fluid which is the motive force for propulsion in these devices. Furthermore, the thickening and delamination of the upper boundary layers can also cause thickening and delamination (breakdown) of the Prandtl layer which will disrupt fluid flow until the Prandtl layer is re-established and stabilizes. This type of boundary layer instability in part caused by the differential velocity between the centre of rotation of a fluid moving member and the velocity of the outer edges of a fluid moving member. The existence of the Prandtl layer is required for a fluid moving member to effectively transfer energy to the fluid. Therefore preventing degradation of the Prandtl layer (eg. the collapse of the Prandtl layer due to the sudden thickening of the Prandtl layer) increases the efficiency of the fluid moving member.

In accordance with the instant invention, power is delivered to the fluid moving member to prevent the Prandtl layer from collapsing or delaminating and to reduce vorticity caused by other boundary layers collapsing. By maintaining an effective Prandtl layer on the fluid moving member for a greater time, more of the energy which is input into the system to cause the fluid moving member to rotate will be transmitted to the fluid passing over the fluid moving member. Accordingly, a pulse train is modulated to vary the acceleration (which may be negative acceleration, i.e. a deceleration) of the fluid moving member to reduce the degradation of the Prandtl layer and other boundary layers which form when the fluid moving member moves through the fluid for systems directly driven by an electric motor. Alternately, the desired acceleration and deceleration of the fluid moving member can be achieved by applying a pulse train signal to an electromagnetic clutch which couples a prime mover to the fluid moving member. In the case of an electromagnetic clutch, the series of electrical pulses cause differential slip to occur in the clutch thereby accelerating and decelerating the fluid moving member. A further alternative method produces the desired acceleration and deceleration of the fluid moving member by applying a pulse train of hydraulic pressure pulses to a hydraulic mechanical clutch which couples a prime mover to the fluid moving member. In the case of an hydraulic mechanical clutch, the series of pressure pulses cause differential slip to occur in the clutch thereby accelerating and decelerating the fluid moving member. A fourth alternative method applies to a design wherein a gasoline or diesel engine is the prime mover which is directly coupled to the fluid moving member. In this fourth example, the fuel flow rate and/or the spark temperature are modulated such that a reduced amount of fuel or lesser spark would decelerate the output shaft while extra fuel and a higher spark temperature would accelerate the output shaft. In this manner the desired accelerations and decelerations could be created.

The cyclic thickening of the boundary layer on the fluid moving member occurs when the power is supplied uniformly to the fluid moving member. In accordance with the instant invention, the fluid moving member is decelerated (i.e. the rate of rotation reduced) prior to the Prandtl layer collapsing or delaminating. When the fluid moving member is decelerated, the Prandtl layer begins to thin and would otherwise collapse if the relative motion between the fluid and the fluid moving member is reduced to below a critical threshold velocity. Therefore, the fluid moving member is again accelerated to maintain the Prandtl layer and other boundary layers within a thickness range which is optimal for transmitting energy from the fluid moving member to the fluid.

Another aspect of the instant invention relates to the acoustic signature which is produced when the fluid moving member and its associated drive mechanism are accelerated and decelerated to prevent the Prandtl layer from collapsing or delaminating and to reduce vorticity caused by other boundary layers collapsing. By maintaining an effective Prandtl layer on the fluid moving member for a greater time, less energy is transferred to vorticity resulting in reduced noise generation. Hence a vessel would operate more silently. In addition, a specific acoustic signature could be created by controlling the pulse train so as to modulate the acceleration of the fluid moving member to produce the desired acoustic signature. Alternately, the desired acceleration and deceleration to produce the desired acoustic signature can be achieved by applying a pulse train signal to an electromagnetic clutch which couples a prime mover to the fluid moving member. In the case of an electromagnetic clutch, the series of electrical pulses cause differential slip to occur in the clutch thereby accelerating and decelerating the fluid moving member. A further alternative method produces the desired acceleration and deceleration of the fluid moving member by applying a pulse train of hydraulic pressure pulses to an hydraulic mechanical clutch which couples a prime mover to the fluid moving member. In the case of a hydraulic mechanical clutch, the series of pressure pulses cause differential slip to occur in the clutch thereby accelerating and decelerating the fluid moving member. A fourth alternative method applies to a design wherein a gasoline or diesel engine is the prime mover which is directly cooled to the fluid moving member. In this fourth example, the fuel flow rate and/or the spark temperature are modulated such that a reduced amount of fuel or lesser spark would decelerate the output shaft while extra fuel and a higher spark temperature would accelerate the output shaft. In this manner the desired accelerations and decelerations could be created to control the acoustic signature of the drive system.

This invention has particular applicability to aircraft, surface vessels, sub-surface vessels, missiles and torpedoes. As such, the prime mover is typically attached to the hull of the vessel or fuselage of the aircraft or missile so as to translate the thrust from the fluid moving member such as a propeller, impeller, or turbine assembly. What the inventor has realized is that if the drive system of the fluid moving member is configured so as to cause deceleration just prior to the collapse or delamination of the Prandtl layer, and to accelerate shortly thereafter to re-thicken or re-establish the Prandtl layer and prevent it from completely collapsing. Thus the Prandtl layer simply reduces or thins down rather than collapse or delaminate. Further, the acceleration results in the Prandtl layer being built up faster. In effect, this reduces the vortex energy thrown off from the blade, and hence significantly reduces energy losses. Accordingly, the algorithm for the pulse train for a vacuum cleaner should be developed, with this in mind. This is done simply by running a series of tests or experiments on the complete system or a scale model thereof, which will allow for any effects which will alter the power consumption of the prime mover and/or control the acoustic signature.

Therefore, in one aspect of the invention, there is provided a method of moving a fluid using a fluid moving member, the method comprises providing power to rotate the fluid moving member and form a Prandtl layer of fluid on the fluid moving member as the fluid moving member moves and, varying the rate of rotation of the fluid moving member to reduce the degradation of the Prandtl layer as the fluid travels over the fluid moving member. The fluid moving member may comprise the power transfer member of a pump and the method further comprises driving the fluid moving member to cause the fluid to flow.

DESCRIPTION OF THE PREFERRED EMBODIMENT

Figure 1:
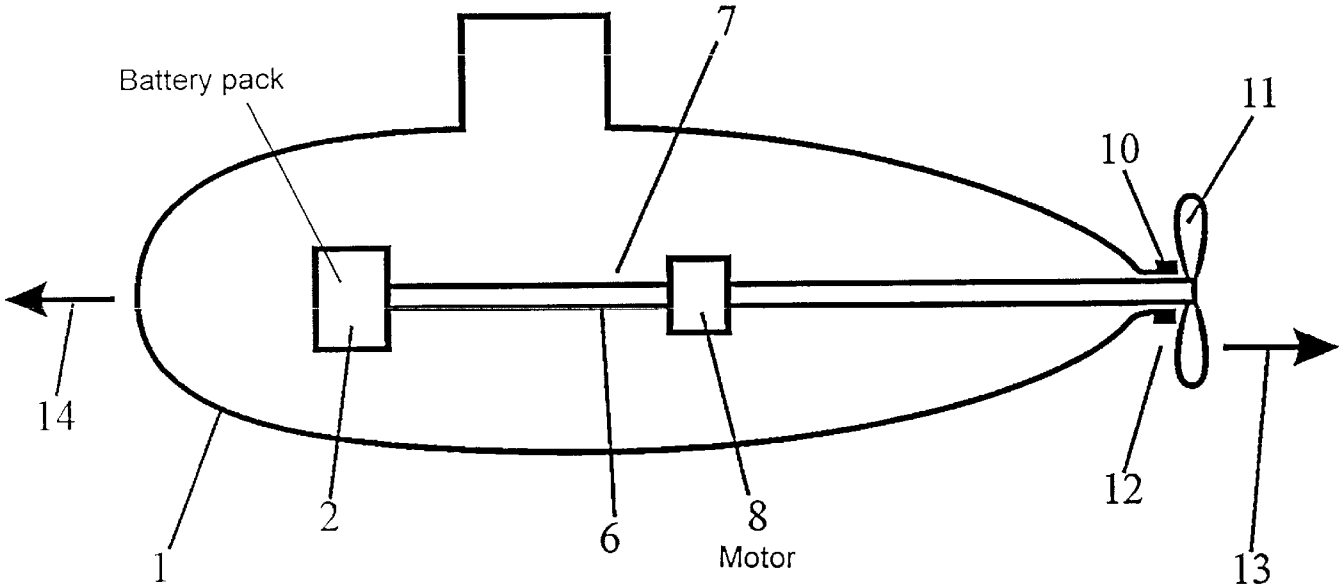
Figure 1 Prior Art
FIG. 1 depicts a cross section of a sub surface vessel known in the art wherein a generator or batteries drives an electric motor which is directly coupled to the propeller.
Figure 2:
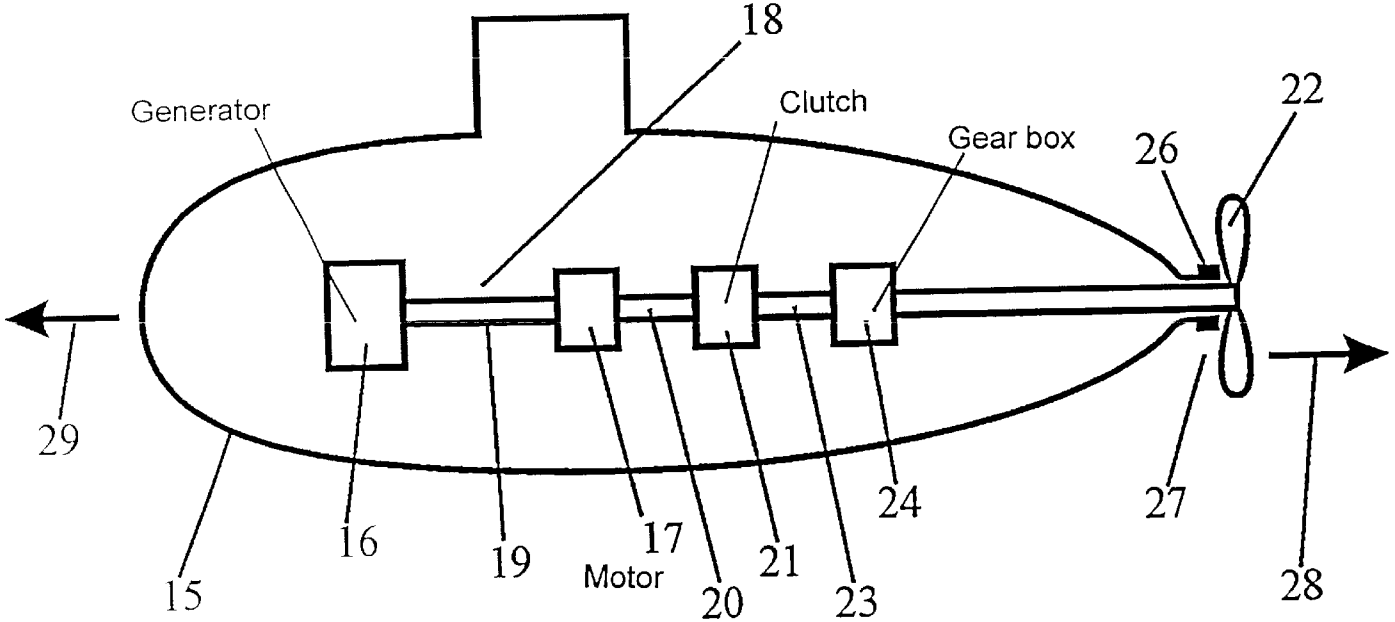
Figure 2 Prior Art
FIG. 2 depicts a cross section of a sub surface vessel known in the art wherein a generator or batteries drives an electric motor coupled to the propeller by means of an electromagnetic clutch and a gear box.
Figure 3:
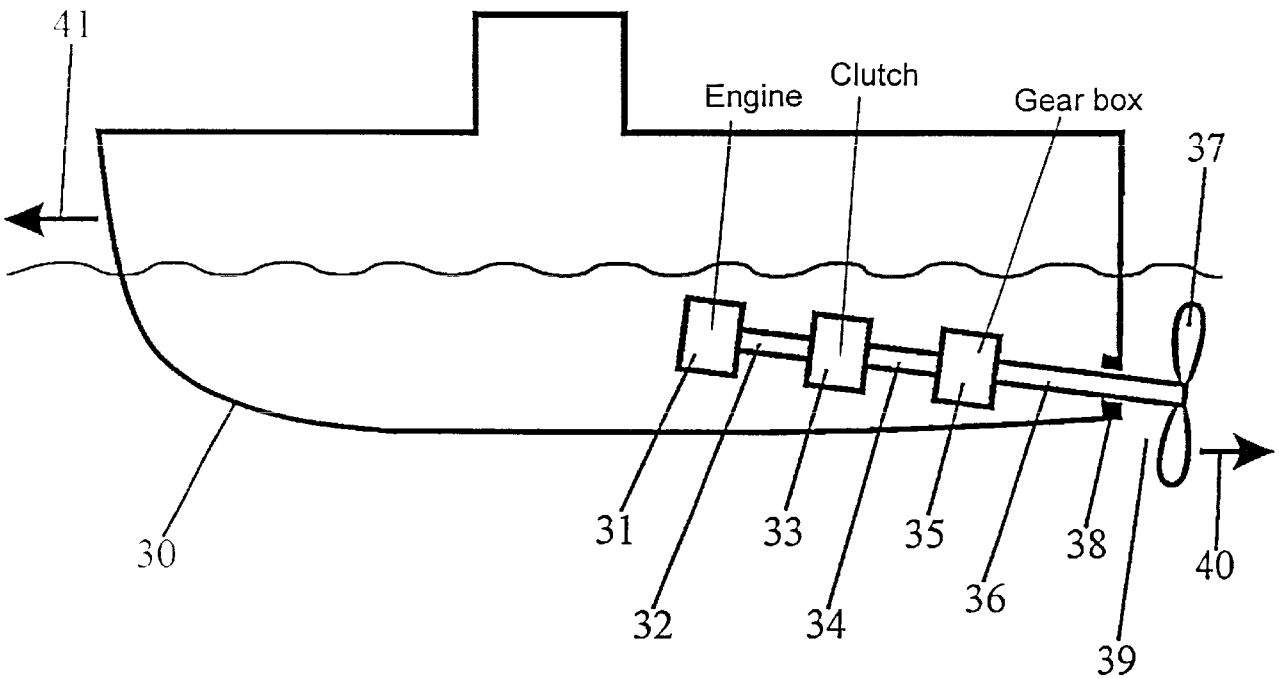
Figure 3 Prior Art
FIG. 3 depicts a cross section of a surface vessel known in the art wherein the diesel or gasoline engine is coupled to the propeller by means of a hydraulic clutch and a gear box.
Figure 4:
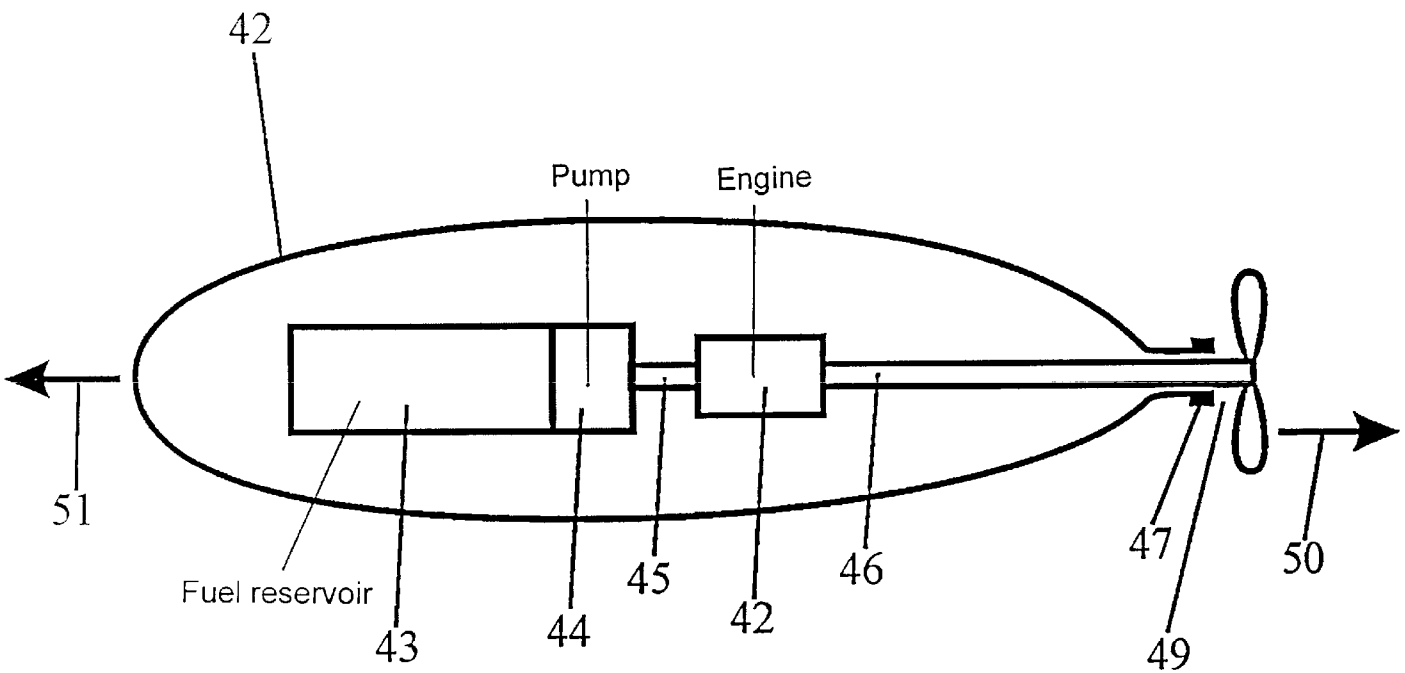
Figure 4 Prior Art
FIG. 4 depicts a cross section of a design for a torpedo known in the art.
Figure 5:
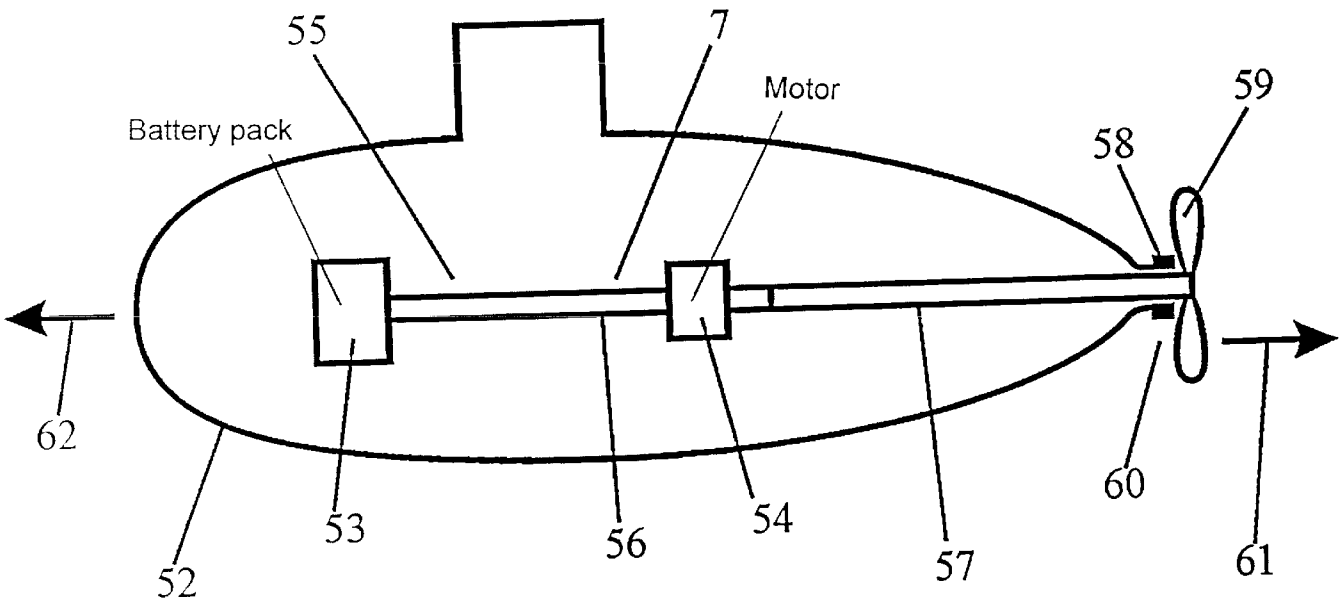
FIG. 5 depicts a cross section of a subsurface vessel of the preferred embodiment in which a pulse train power supply drives the electric motor which is directly coupled to the propeller such that the motor provides the desired accelerations and decelerations in the propeller.

A cross section of a subsurface vessel of the preferred embodiment is shown in FIG. 5. The drive train described within FIG. 5 is also applicable to surface vessels. It is common for surface and subsurface vessels to be powered by a nuclear or diesel driven electric generator or batteries. The propulsion system of subsurface vessel 52 includes a nuclear or diesel driven electric generator or battery pack 53 which produces either alternating current or direct current electricity except for batteries which only produce direct current. The alternating current or direct current electricity is in turn delivered to motor 54 by means of wires 55 and 56. Output shaft 57 of electric motor 54 is supported by means of a bearing 58 and has propeller 59 affixed to it.

The rotation of propeller 59 in turn causes fluid 60 within which subsurface vessel 52 is suspended to be ejected from propeller 59 in a direction 61 which in turn causes subsurface vessel 52 to move forward in direction 62. By reversing the input voltage polarity to electric motor 54, the direction of rotation of electric motor 54 can be reversed which causes fluid 60 to flow in direction 62 away from propeller 59 which thereby causing the subsurface vessel 52 to move in the direction 61. In this arrangement, the cavitation, vortical flow, and noise from the propeller is controlled by accelerating and decelerating propeller 59 by applying an electrical wave train input to the electric motor 54 which causes said electric motor 54 to accelerate and decelerate.

Figure 6:
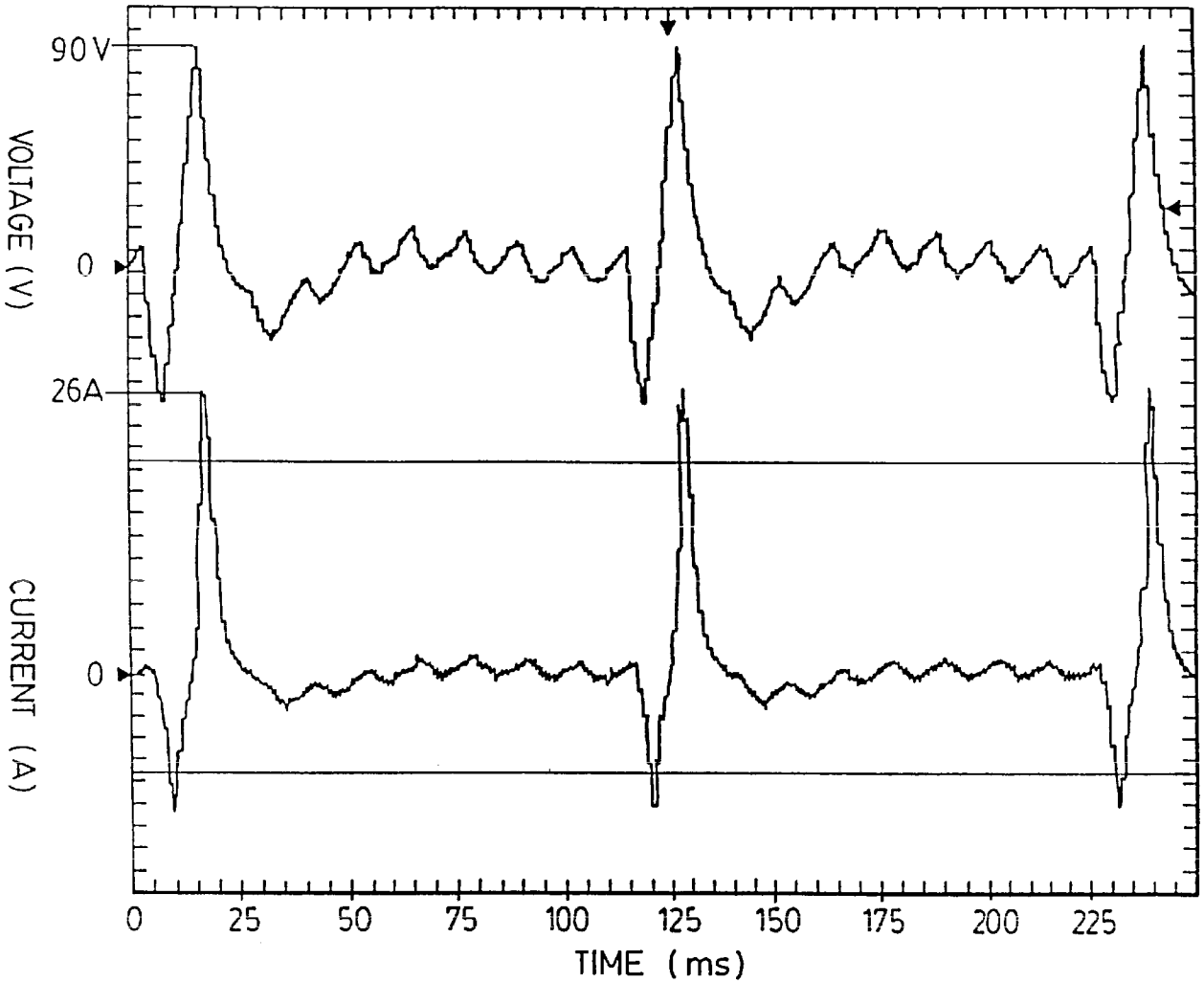
FIG. 6 depicts a pulsed wave train waveform which is applied to the electric motor of a subsurface vessel such that 20% of the power within 10% of the time of one period of the waveform so as to create the desired accelerations and decelerations in the motor and the propeller.

A pulsed wave train waveform is applied to the electric motor such that 20% of the power which is transmitted to propeller 59 is provided in 10% of the time of one period of the waveform as shown in FIG. 6. Thus at least 20% of the power delivered in the waveform is typically delivered in 10% of the cycle of one wave train.

Preferably, the portion of the wave train provides 30%–70%, more preferably 40–60% and most preferably 45%–55% of the total power the propeller receives each second.

The frequency of the pulse train may vary from 6–20 Hz and preferably 9–15 Hz. Further, each cycle may contain from 1–20, preferably 5–20, more preferably 5–15 and most preferably 9–13 pulses or differing accelerations. For example, the pulse train may be produced by providing a constant power supply to the propeller (eg. a constant DC or AC signal) and superimposing on the signal which is supplied to the propeller one or more pulses. Thus, if a single pulse is superimposed, the propeller will receive a signal providing a continuous power level and, once a cycle, a signal at a higher power level. Preferably, in the case of an electric signal, the increased power is provided by increasing the voltage of the signal supplied to the propeller. It will be appreciated that a power control system for a mechanical system may be operated in the same manner. In such a case, it will be appreciated that if mechanical power is being applied to a propeller, then the series of pulses are effectively applied in a cycle which is preferably of the same frequency as an electrical signal as taught herein.

By way of example, a pulse train signal was used to drive a small scale model of a submarine. The power was supplied from a battery having a capacity of 14.4 volts. The current supplied to the motor was modulated such that 14.4 VDC was applied to the motor continuously and a 12 ms pulse of 104 VDC is also applied at a repetition rate of 9 Hz. Thus 50% of the power to the motor was supplied as DC and 50% of the power was supplied by the 104 VDC pulses so as to provide a peak voltage of about 115V. This caused shaft 57 of electric motor 54 to periodically accelerate and decelerate thereby causing the desired motion in the fluid moving member, propeller 59. The cyclical acceleration and deceleration of propeller 59 reduced the degradation of the prandtl layer and thus more power was transmitted to the water and the speed of the submarine increased. Reducing the cavitation and improving the Prandtl layer and boundary layer flow over the propeller by said means increased the maximum velocity of the subsurface vessel by 5–8% and reduced the power required to achieve a given speed by up to 44%.

Figure 7:
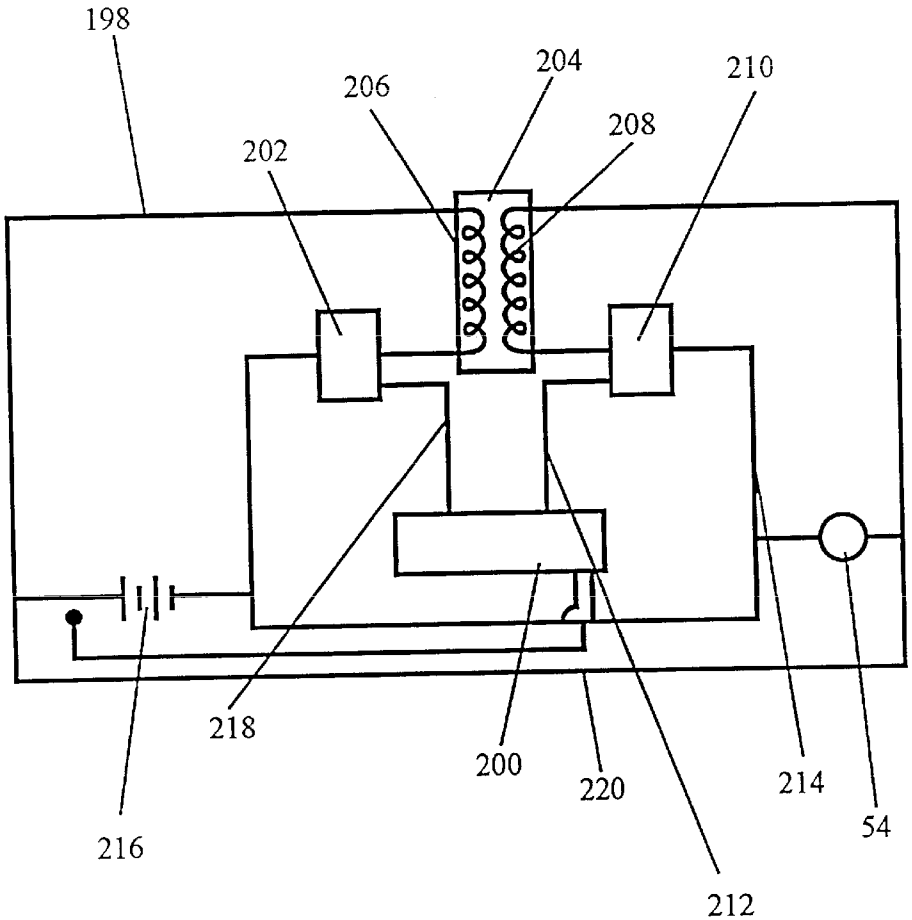
FIG. 7 depicts a schematic which produces the pulsed wave train waveform which is applied to the electric motor of a subsurface vessel such that 20% of the power within 10% of the time of one period of the waveform so as to create the desired accelerations and decelerations in the motor and the propeller.

The electronic circuit 198 employed in this model is shown in FIG. 7. Power control circuit 198 comprises a motor controller. Battery 216 supplies 50% the power for motor 54 as DC current through wire 220. The other half of the power is supplied to the motor through an inverter (namely field effect transistor 206 and transformer 204). This has the advantage that half the power is transmitted as DC (which has nominal circuit losses) and half is transmitted through the inverter (which may have an efficiency of eg. about 85%) for an overall efficiency of about 92.5%. It is recognized that by increasing the power channelled through the inverter, the flow rate of the mechanical system can be controlled. However, increasing the power channelled through the inverter increases the heat losses through the circuit and mitigates a portion of the energy saving realized in the fluid mechanical portion of the system. It will be appreciated the battery 216 may supply all of the power to motor 54 through the inverter circuit resulting in about a 7.5% reduction in the power savings. The instant design also advantageously allows multiple power levels to be supplied to motor 54.

When movement of the vessel is required, controller 200 receives a signal from switch known in the art and in turn starts to oscillate field effect transistor 202 at a high frequency (e.g. about 60 Khz) as controlled by controller 200 by means of wire 218. Circuit 198 is provided with transformer 204 having primary and secondary coils 206 and 208. The high frequency oscillation produced by field effect transistor 202 causes primary coils 206 to induce a high voltage in secondary coils 208. The high voltage induced in second coil 208 is switched on and off by field effect transistor 210 at a much lower frequency (e.g. 9 Hz) as controlled by controller 200 by means of wire 212.

Field effect transistor 210 is connected to motor 54 via wire 214. Accordingly, the pulse train developed by field effect transistor 210 is supplied to motor 54 so as to cause sub-rotational accelerations as described herein whereby the efficiency of the power transfer from motor 54 to the fluid stream passing through propeller 59 is improved. It will be appreciated that the pulse which is provided to motor 54 may be varied by changing the frequency of field effect transistor 210.

Typically, sonar or other acoustic tracking means use the noise produced by a vessel to track the vessel. The noise detected by such means is primarily produced by the rotation of the propeller. The pulse train stabilizes the Prandtl layer on the propeller (eg. keeping it within a minimum and a maximum thickness) thereby reducing the overall noise produced and making identification and tracking of the vessel more difficult.

In accordance with another embodiment of the instant invention, the pulse train may be occasionally altered so as to periodically change the noise signature of a vessel. For example, additional wave train pulses can cause further accelerations and deceleration which can further alter the mechanical resonance of the generator, electric motor and associated mechanical linkages produce a range of different characteristic noise signatures which can be dynamically altered thereby making identification and tracking of the vessel more difficult. Therefore, the pulse train may be occasionally altered to change the noise signature of a vessel. Thus, a person tracking a vessel using sonar will have difficulty determining the number of vessels which are present.

Other vessel in the vicinity may produce a similar noise signature. Therefore, it can be difficult for one vessel to locate other vessels. By occasionally changing the pulse train to change, eg, the frequency of the noise emitted by their vessel, a person may then scan the surrounding environment for other vessels which may be operating on the same sound spectrum as their vessel was previously operating prior to the change in the pulse train.

In accordance with another embodiment of the instant invention, the pulse train may be occasionally altered so as to change the noise signature of a vessel so that the noise signature is that of a different vessel. Thus, for example, a decoy boat may be tuned so as to sound like a destroyer or a submarine may be tuned to sound like a natural phenomenon (eg., waves breaking on shore or an a reef or volcanic vent) or marine life. In particular, in these latter two modes of operation, a vessel may mask itself so that using acoustic means it is indistinguishable from naturally occurring background noise.

The pulse train which is required for any of the modes of operation disclosed herein may be easily determined by varying the pulse train within the parameters set out herein. For example, initially, the normal running voltage for the motor is applied and the frequency is increased in 10% increments. At each frequency increment, the pulse width of the signal is reduced until either the power consumed decreases by, eg., 25% or the motor r.p.m. is altered by more than 20%. This procedure is repeated for selected voltages, preferably 250% of the normal running voltage down to 20% of the normal running voltage such as by 10% decrements. When a voltage greater than the internal operating voltage is applied, the energy delivered in the pulses is kept to a level below the level at which degradation of the insulation by heat, or other physical damage will occur by reducing the duration (time) associated with the pulses. This data is then topographically mapped and an algorithm to optimize the motor is selected so as to reduce the power consumed by modulating the applied voltage, applied frequency and pulse width of the signal. If the pulse train is to mimic another sound (eg,. a natural phenomenon, wild life or another vessel), then the noise signature produced by the vessel is monitored until a pulse train providing the desired noise signature is obtained.

Figure 8:
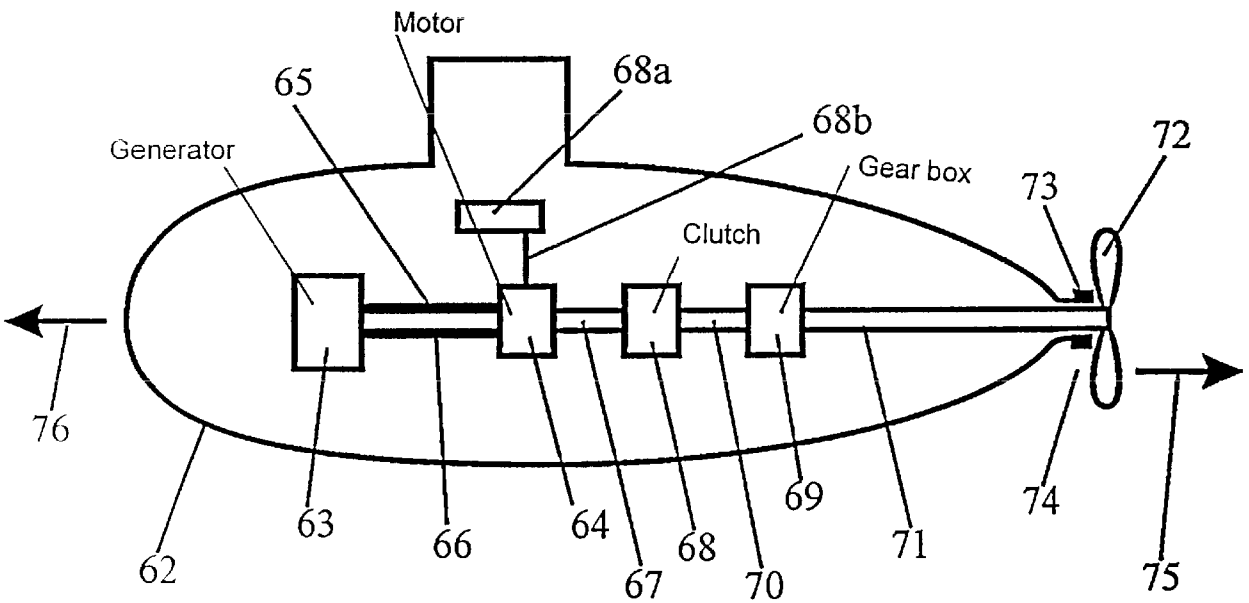
FIG. 8 depicts a cross section of a sub surface vessel of another preferred embodiment wherein a generator or batteries drives an electric motor coupled to the propeller by means of an electromagnetic clutch and a gear box in which the electromagnetic clutch provides differential slip to create the desired accelerations and decelerations in the propeller.

A cross section of another design of subsurface vessel is shown in FIG. 8. The drive train described within FIG. 8 is also applicable to, eg. surface vessels. The propulsion system of subsurface vessel 62 includes a nuclear or diesel driven electric generator 63 which produces either alternating current or direct current electricity except for batteries which only produce direct current. The alternating current or direct current electricity is in turn delivered to the electric motor 64 by means of wires 65 and 66. Output shaft 67 of electric motor 64 is coupled to a clutch 68 which selectively engages and disengages electric motor 64 from gear box 69. Output shaft 70 from clutch 68 is coupled with the gear box 69 whose output shaft 71 has propeller 72 affixed. A bearing 73 supports output shaft 71 from gear box 69. The purpose of gear box 69 is to reduce the high rotational speed from shaft 67 of motor 64 to which it is coupled by means of clutch 68 to a rotational speed suitable for driving propeller 72 efficiently. When AC or DC electricity is applied to the electric motor 64, the shaft of electric motor 64 begins to rotate and accelerates to a uniform rotational velocity (rpm), When the clutch 68 is engaged, the rotational energy of electric motor 64 is transferred to the gear box 69 by means of shafts 67 and 70 respectively which in turn causes shaft 71 to spin which thereby causing the propeller 72 to spin. A controller 68*a* controls the electromagnetic clutch 68 by means of wire 68*b*.

The rotation of propeller 72 in turn causes fluid 74 within which vessel 62 is immersed to be ejected from propeller 72 in direction 75 when vessel 62 wishes to move forward in direction 76. By reversing the direction of rotation of electric motor 64, fluid 74 within which vessel 72 is suspended would flow in direction 76 from propeller 72 thereby causing vessel 62 to move in direction 75.

Alternately, the portion of clutch 68 and gear head 69 may be reversed in their mechanical connection. In this preferred embodiment, the cavitation of the propeller and the mechanical resonance of the generator, electric motor and associated mechanical linkages produce a characteristic noise "signature" which can be alters and/or diminished by the application of the appropriate signal to the electromagnetic clutch 68.

By way of example, a 12 VAC, 60 Hz signal was applied to the electromagnetic clutch constantly as well as a 48 VAC, 60 Hz signal which was pulsed on for 16 ms and off for approximately 84 ms hence a repetition rate of approximately 10 Hz is achieved with each cycle comprising a short pulse of about 60 VAC and a constant signal of 12 VAC. (The frequency and phase of the signal were matched). This produced an acceleration and deceleration pattern to drive the shaft 70 which in turn drove the gear box 69 and the shaft 71 to which propeller 72 is coupled. This signal periodically accelerated and decelerated the shaft drivingly connected to propeller 59 thereby causing the desired motion in the fluid moving member, propeller 59. Experimental testing of this scale model increased the velocity of the vessel by 4% and reduced the power required to achieve a given speed by 23%.

Figure 9:
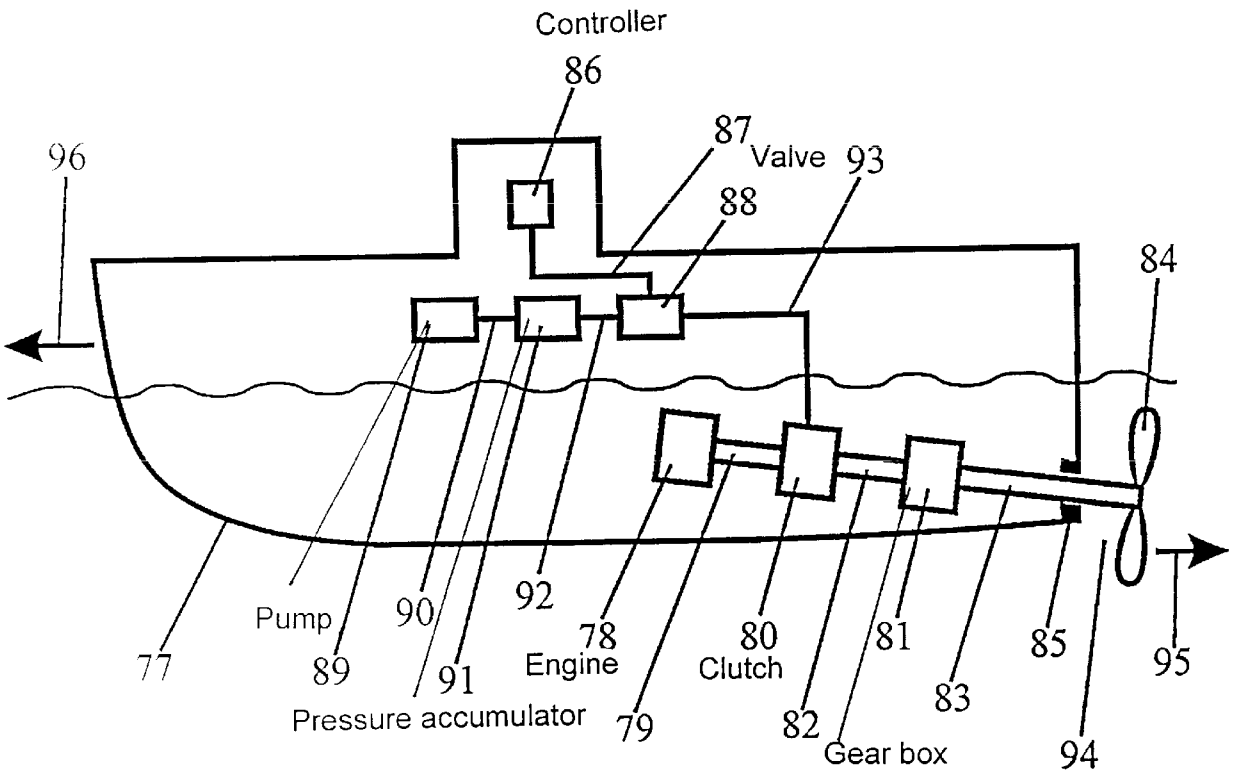
FIG. 9 depicts a cross section of a surface vessel of another preferred embodiment wherein a diesel or gasoline engine is coupled to the propeller by means of a hydraulic clutch and a gear box in which the hydraulic clutch slip is modulated to prove differential slip to create the desired accelerations and decelerations in the propeller.

A cross section of a design for a surface vessel is shown in FIG. 9. The drive train described within FIG. 9 could be applicable to subsurface and other vessels. The propulsion system of surface vessel 77 includes diesel or gasoline engine 78. Output shaft 79 of diesel or gasoline engine 78 is coupled to a hydraulic clutch 80 which selectively engages and disengages diesel or gasoline engine 78 form gear box 81. Output shaft 82 of clutch 80 is coupled with gear box 81 whose output shaft 83 has propeller 84 affixed. Bearing 85 supports output shaft 83 from gear box 81. The purpose of gear box 81 is to reduce the high rotational speed from shaft 79 of diesel or gasoline engine 78 to a rotational speed suitable for driving propeller 84 efficiently.

When diesel or gasoline engine 78 is started, output shaft 79 of diesel or gasoline engine 78 begins to rotate and accelerates to a uniform rotational velocity (rpm). Clutch 80 is periodically engaged and disengaged such that the constant rotational motion of diesel or gasoline engine 78 is transferred to gear box 81 as a series of accelerations and decelerations which accelerations and decelerations are transferred to propeller 84 by means of shaft 83 causing said propeller to spin. Hydraulic pump 89 delivers pressurized liquid through hose 90 to pressure accumulator 91 which feeds pressure through hose 92 to electromechanical valve 88. Controller 86 controls the opening and closing patterns of electromechanical valve 88 by means of wire 87. Opening and closing of electromechanical valve 88 causes pressure pulses to be delivered to hydraulic clutch 80 by means of hose 93. The electromechanical valve is opened for, eg., 19 ms and closed for, eg., 81 ms for a frequency of operation of approximately 10 Hz. The pressure pulses to the clutch cause differential slip which in turn produces an acceleration and deceleration pattern to be delivered to drive shaft 82 which in turn drives gear box 81 which in turn drives shaft 83 to which propeller 84 is connected.

This setup to periodically accelerate and decelerate propeller 84 thereby causing the desired motion in the fluid moving member, propeller 84 which improves speed and fuel economy. The rotation of propeller 84 in turn causes fluid 94 within which vessel 77 is immersed to be ejected from propeller 84 in a direction 95 when vessel 77 wishes to move forward in direction 96. By reversing the direction of rotation of diesel or gasoline engine 78, fluid 94 within which vessel 62 is immersed would flow in direction 96 from propeller 84 thereby causing vessel 77 to move in direction 95.

Alternately, the position of clutch 80 and gear head 81 may be reversed in their mechanical connection. In this preferred embodiment, the cavitation of the propeller and the mechanical resonance of the generator, electric motor and associated mechanical linkages produces a characteristic noise "signature" which can be altered and/or diminished by the application of the appropriate signal to the clutch 80. Experimental testing of a scale model of this system using the pulse train set put above increased the velocity of the vessel by 3% and reduced the power required to achieve a given speed by 25%.

Figure 10:
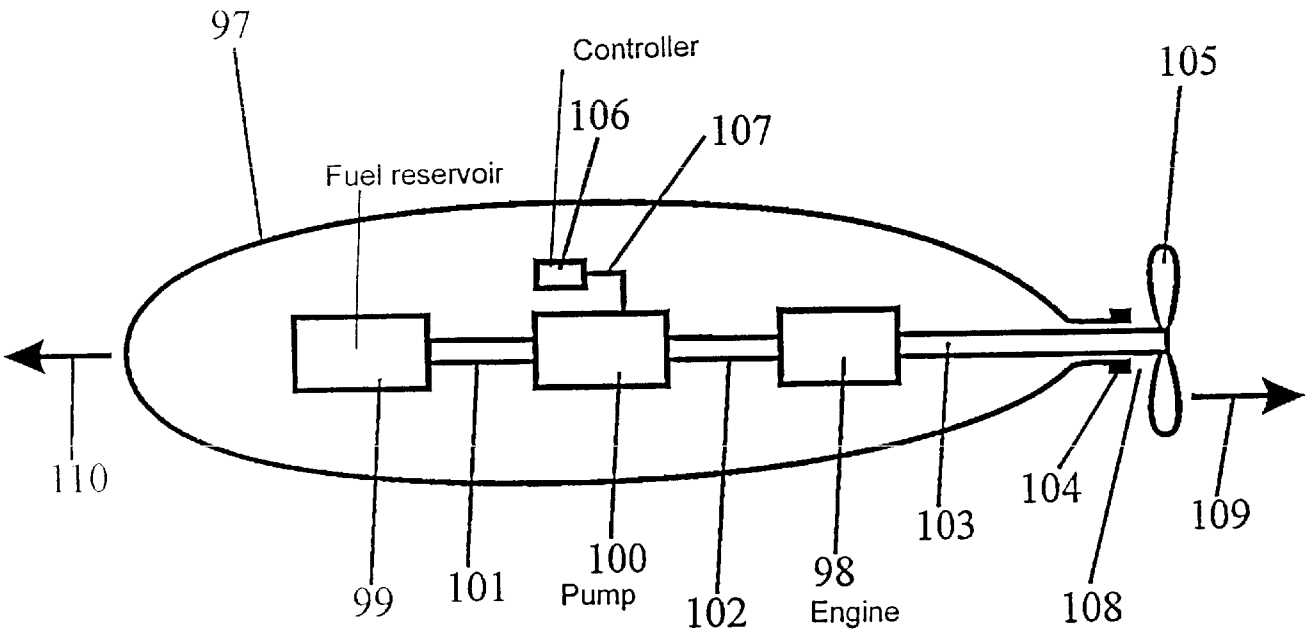
FIG. 10 depicts a cross section of another preferred embodiment of a torpedo wherein a combustion engine is coupled directly coupled to the propeller and the fuel flow to the combustion engine is modulated so as to create the desired accelerations and decelerations in the propeller.

A cross section of a design for a preferred embodiment of a torpedo is shown in FIG. 10. The drive train described within FIG. 10 could be applicable to other vessels such as missels and aircraft. Torpedo 97 is powered by combustion engine 98 which receives self-oxidizing fuel from fuel reservoir 99 by means of fuel pump 100 which delivers a steady stream of fuel from tube 101 through tube 102 to the combustion engine 98. Combustion engine 98 causes a constant rotation of shaft 103 which is supported by bearing 104 and to which propeller 105 is affixed. The guidance and control systems and explosive systems of such a device are not of concern in this invention and any known in the art may be used. When combustion engine 98 is started, output shaft 103 begins to rotate and accelerate as fuel is injected to combustion engine 98 at a constant flow rate as determined by controller 106 which is connected to fuel pump 100 by means of wire 107. After, eg., 10 seconds of constant fuel flow, the fuel flow is modulated such as it is periodically reduced and then increased so as to create the desired accelerations and decelerations in the rotational energy of combustion engine 98 which is in turn transferred to propeller 105 by means of shaft 103. The rotation of propeller 105 in turn causes fluid 108 within which torpedo 97 is immersed to be ejected from propeller 105 in a direction 109 which causes torpedo 97 to move forward in direction 110. In this embodiment, the cavitation of the propeller and the mechanical resonance of the motor, clutch, propeller and associated mechanical linkages is controlled by modulating the fuel flow to combustion engine 98 to produce optimum thrust and fuel economy and to control the noise "signature" of the torpedo which can be used to identify the torpedo and helps to determine its approximate speed and position. The use of a modulated fuel delivery system may increase the range of a torpedo by 20% to 45% and increase its velocity by 11% to 34% or more.

I claim:

1. A method of driving a vessel comprising the steps of:

(a) providing power from a power source to a rotatably mounted fluid moving member which is mounted to the vessel;

(b) producing changes in the rate of rotation of the fluid moving member whereby a series of differing accelerations are applied in a repeating pattern to cause rotation of the fluid moving member, said a series of the differing accelerations delivering power to the fluid moving member, wherein a portion of the series having a duration of 10% of the pattern delivers more than 20% of the power to the fluid moving member which the fluid moving member receives during the repetition of each series whereby the rotation of the fluid moving member imparts movement to the vessel and produces a noise signature.

2. The method as claimed in claim 1 further comprising the step of adjusting the rotation to reduce the noise signature of the vessel.

3. The method as claimed in claim 1 further comprising the step of adjusting the rotation to match the noise signature of the vessel to the noise signature of another vessel.

4. The method as claimed in claim 1 further comprising the step of adjusting the rotation to match the noise signature of the vessel to the noise signature of a natural phenomenon.

5. The method as claimed in claim 1 further comprising the step of adjusting the rotation to match the noise signature of the vessel to the noise signature of wildlife.

6. The method as claimed in claim 1 further comprising the step of adjusting the rotation to reduce degradation of a Prandtl layer which forms on the fluid moving member as fluid travels over the fluid moving member.

7. The method as claimed in claim 1 wherein the portion provides 30–70% of the power the fluid moving member receives each second.

8. The method as claimed in claim 1 wherein each series comprises 1–20 differing accelerations.

9. The method as claimed in claim 1 wherein each series comprises 5–20 differing accelerations.

10. The method as claimed in claim 1 wherein the rate of rotation of the fluid moving member is varied at least once during each revolution of the fluid moving member whereby the rate of rotation of the fluid moving member is non-uniform.

11. A method of driving a vessel which has a particular thermodynamic efficiency comprising the steps of:

(a) providing power from a power source to a rotatably mounted fluid moving member to rotate the fluid moving member and form a Prandtl layer of fluid on the fluid moving member as the fluid moving member moves wherein the fluid moving member is mounted to the vessel; and, (b) varying the rate of rotation of the fluid moving member in a repeated pattern to reduce the degradation of the Prandtl layer as the fluid travels over the fluid moving member and increase the thermodynamic efficiency whereby the rotation of the fluid moving member imparts movement to the vessel.

12. A method of driving a vessel having a fluid moving member which produces a particular noise signature during operation, the method comprising the steps of:

(a) providing power from a power source to a rotatably mounted fluid moving member to rotate the fluid moving member and form a Prandtl layer of fluid on the fluid moving member as the fluid moving member moves wherein the fluid moving member is mounted to the vessel; and, (b) varying the rate of rotation of the fluid moving member to alter the noise signature produced by the fluid moving member in a repeated pattern to a noise signature which is not characteristic of the vessel whereby the rotation of the fluid moving member imparts movement to the vessel.

13. The method as claimed in claim 12 further comprising the step of adjusting the rotation to match the noise signature of the vessel to the noise signature of another vessel.

14. The method as claimed in claim 12 further comprising the step of adjusting the rotation to match the noise signature of the vessel to the noise signature of a natural phenomenon.

15. The method as claimed in claim 12 further comprising the step of adjusting the rotation to match the noise signature of the vessel to the noise signature of wildlife.

16. The method as claimed in claim 12 further comprising the step of adjusting the rotation to reduce degradation of a Prandtl layer which forms on the fluid moving member as fluid travels over the fluid moving member.

17. The method as claimed in claim 12 wherein the fluid moving member receives power and the portion provides 30–70% of the power the fluid moving member receives each second.

18. The method as claimed in claim 12 wherein each series comprises 1–20 differing accelerations.

19. The method as claimed in claim 12 wherein each series comprises 5–20 differing accelerations.

20. The method as claimed in claim 12 wherein the rate of rotation of the fluid moving member is varied at least once during each revolution of the fluid moving member whereby the rate of rotation of the fluid moving member is non-uniform.

21. The method as claimed in claim 12 wherein the change in the rate of rotation of the fluid moving member is produced by a member that is electrically driven and the method further comprises the step of providing a first electrical signal to the member and periodically superimposing a second signal to the member whereby the member periodically receives a pulse at a higher voltage than the first electrical signal.

22. The method as claimed in claim 12 wherein the fluid moving member is driven by an electric motor and the method further comprises the step of providing a first electrical signal to the motor and periodically superimposing a second signal to the motor whereby the motor periodically receives a pulse at a higher voltage than the first electrical signal.

* * * * *